United States Patent [19]

Thiele

[11] 4,215,891

[45] Aug. 5, 1980

[54] SLING MOUNTING HEAD

[76] Inventor: Alfred Thiele, Am Tyrol 17c, 5860 Iserlohn, Fed. Rep. of Germany

[21] Appl. No.: 947,747

[22] Filed: Oct. 2, 1978

[30] Foreign Application Priority Data

Oct. 11, 1977 [DE] Fed. Rep. of Germany ..... 2745649

[51] Int. Cl.[2] ..... B66C 1/12

[52] U.S. Cl. ..... 294/74; 294/81 R

[58] Field of Search ..... 294/67 R, 67 DA, 67 DB, 294/67 E, 67 EA, 74–76, 78 R, 78 A, 79, 81 R

[56] References Cited

U.S. PATENT DOCUMENTS

| | | | |
|---|---|---|---|
| 847,738 | 3/1907 | Darnall | 294/79 |
| 1,505,663 | 8/1924 | Oliver et al. | 294/74 |
| 1,970,617 | 8/1934 | Morgan | 294/74 X |
| 2,622,540 | 12/1952 | Stewart et al. | 294/74 X |
| 3,021,166 | 2/1962 | Kempel et al. | 294/74 |

FOREIGN PATENT DOCUMENTS

| | | | |
|---|---|---|---|
| 2301571 | 8/1973 | Fed. Rep. of Germany | 294/81 R |
| 1101157 | 1/1968 | United Kingdom | 294/74 |

*Primary Examiner*—Johnny D. Cherry
*Attorney, Agent, or Firm*—Michael J. Striker

[57] ABSTRACT

A sling mounting head for use with a spacer element and mounting two members of a sling chain, has a body portion including a central section, and first and second end sections extending from the central section. The first end section is arranged to retain the spacing element. The second end section is box-shaped and includes two side walls arranged to receive the two members of a sling chain therebetween and to mount a pin for connecting the two members with each other and retaining them in the body portion. The second end portion has a bottom wall provided with an opening through which one of the two members extends. The central section, the first end section, and the side and bottom wall of the second end section together form an integral member.

11 Claims, 3 Drawing Figures

SLING MOUNTING HEAD

BACKGROUND OF THE INVENTION

The present invention relates to a sling mounting head, for a sling chain suspension system and more particularly to a sling mounting head for use with spacer elements.

Sling mounting heads of the above known type have been proposed in the art. Sling mounting heads are located at opposite sides of a spacer element which, preferably, has a variable length. Each sling mounting head has a solid central section, a retaining boss extending rearwardly from a rear face of the central section and insertable into a tubular end of the spacer element, and two fork plates extending forwardly from a front face of the central section. The fork plates are provided with holes through which a connecting pin releasably extends, for connecting sling chains or suspensions members with one another. The dimensions and strength values of the connecting pins are determined in accordance with predetermined quality grades in mechanical assembly.

In known sling gears with one or more tubular spacer elements having a variable length, the spacer elements are not formed as supporting beams capable to be statically loaded, but serve only to support the load sling points of two-strand chains at a distance. Such gear has a more or less expensive construction. This applies particularly to the sling means mounting head located at the ends of the spacer elements. It is known to provide on each mounting head two connecting forks which are offset relative to one another by 90° and have prongs which are connected by releasable holding pins for intermediate members or end members of the chain strand sections to be connected. It has also been proposed to provide only one fork whose prongs are, however, constructed with abutments for supporting a chain link which follows a chain link slung in the fork.

In accordance with the above-mentioned first embodiment, separate chain strand sections can be mechanically connected either directly with one another or through suspension members by connecting pins which are offset relative to one another by 90°. In accordance with the second-mentioned embodiment only the link of a through-going sling chain can be slung in the single connecting pin. The mounting heads are therefore limited to one or the other mode of mounting. Moreover, they are expensive to manufacture.

SUMMARY OF THE INVENTION

Accordingly, it is an object of the present invention to provide a sling mounting head for a sling chain system, which avoids the disadvantages of the prior art.

More particularly, it is an object of the present invention to provide a sling mounting head which is constructed in accordance with simple technical means so that it is stronger and can be used more universally than the known mounting head, and which is composed inexpensively from a minimum possible number of individual parts.

In keeping with these objects and with others which will become apparent hereinafter, one feature of the present invention resides, briefly stated, in a sling mounting head which has a body portion having a central section, a first end section extending from the central section and arranged to retain a spacer element, and a second end section extending also from the central section and having two side walls adapted to receive two members of a sling chain system to be connected therewith and a bottom wall through which one of the two members extend, wherein the first end section, the central section, and the side and bottom walls of the second end section together form an integral member.

Such a sling mounting head has a material-saving construction and can be manufactured as a drop-forged integral member having high strength. It is constructed for receiving standard fork heads of different sling means in accordance with mechanical assembly systems. It is only necessary to adjust the diameter of the holes in the side walls and the distance between the side walls, as well as the dimensions of the opening formed in the bottom wall, to the dimensions of the connecting pins and the chain links and suspension members in accordance with the different quality grades of the mechanically assembled system. This is to be done to ensure that only standard sling gear and suspension members of the concerned quality grade can be slung on such a mounting head. In addition to suspension hooks, forked shackles, load hooks or the like may be used as suspension members. The sling mounting head in accordance with the present invention thus provides for an excellent completion to already existing mechanically assembled systems in the field of sling means for lifting gears and the like.

In accordance with another feature of the present invention the central portion has an axis, and the end portions are axially spaced from one another. The side walls of the second end portions are forked plates which are spaced from one another in a direction transverse to the axis and are parallel to one another. The side walls are provided with holes for releasably receiving a connecting pin which connects two members of the sling chain system and retains at least one of them.

Still another feature of the present invention is that the fork plates are spaced from one another by a distance such as to receive therebetween the two members of the sling chain system, to be connected with one another. When one of the two members are a suspension member having a fork head provided with two arms, and the other member is a chain link member received between the arms, the fork plates are spaced from one another by a distance such as to receive the suspension member therebetween.

A further feature of the present invention is that the opening provided in the bottom wall of the second end section has such dimensions that the one member which is to be connected with the other member of the sling chain system, extends through the opening with play.

A still further feature of the present invention is that the first end portion is formed as a cylindrical boss whose axis coincides with the axis of the central section. The cylindrical boss is so formed as to be insertable into a hollow of the tubular spacer element.

Finally, an additional feature of the present invention is that the holes provided in the side walls of the second end section have axes which are normal to the axes of the central section and the cylindrical boss so that the connecting pin inserted into the holes extends normal to these axes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
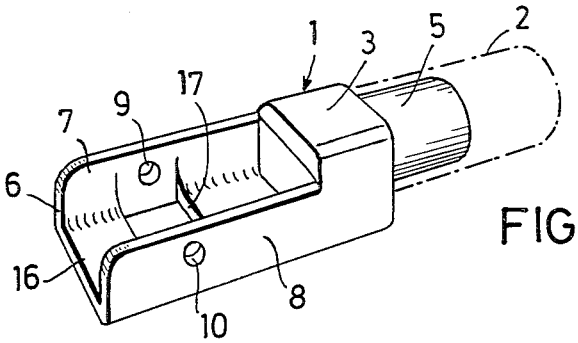
FIG. 1 is a perspective view of a sling mounting head in accordance with the present invention.
Figure 2:
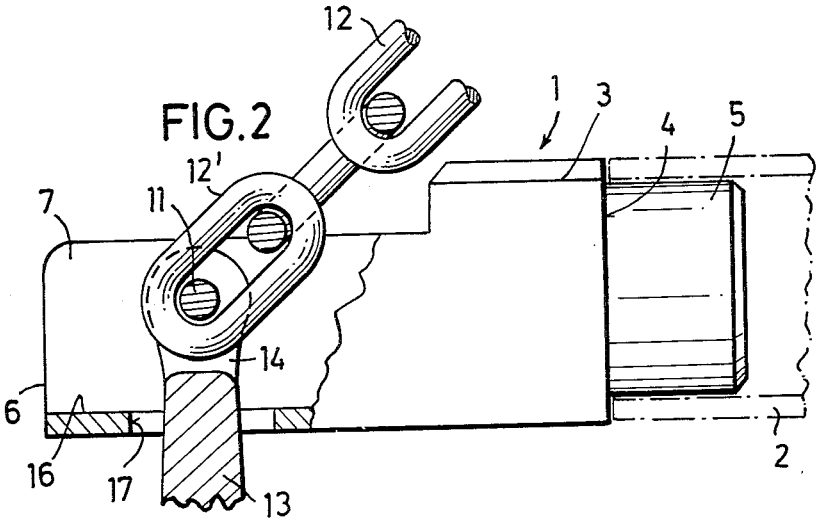
FIG. 2 is a partially sectioned side view of the mounting head located in an end of a tubular spacer element, with a suspension member hanging downwardly from a connecting pin and an end link of a suspension chain slung on the connecting pin.
Figure 3:
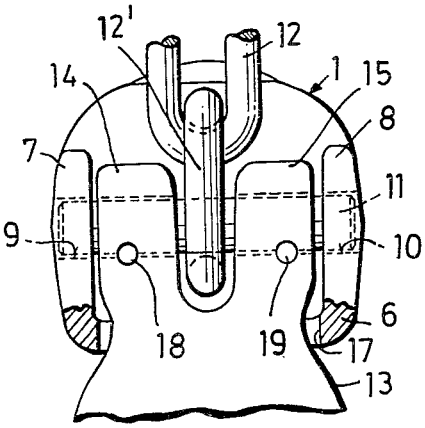
FIG. 3 is a partially sectioned end view of the mounting head shown in FIG. 2.

A sling mounting head in accordance with the present invention is identified in toto by reference numeral 1 and shown in combination with a partially broken-off tubular end 2 of a spacer element. Two such mounting heads may be located at two opposite ends of the spacer element and releasably or fixedly connected to the latter. The mounting head 1 has a solid central section 3 having an axis and two axially opposite end faces. And end section formed as a retaining boss or pin 5 extends rearwardly from one of the end faces of the central section 3 and can be inserted into a hollow of the tubular end 2 of the spacer element. The end section 5 of the mounting head 1 may be secured to the tubular end 2 of the spacer element, if needed, by a locking pin which is known per se in the art and not shown in the drawing. The end section 5 may also be welded to the tubular end 2.

Another end section extends forwardly from the other end face of the central section 3 and is formed as a box-like U-shaped profile 6. The end section 6 has two side walls 7 and 8 and is open at the top. The side walls 7 and 8 form two fork plates which are located at opposite sides of an axis of the central section 3 and extend substantially parallel to one another. The side walls 7 and 8 are provided with holes 9 and 10 into which a connecting pin 11 is inserted. The axes of the holes 9 and 10 and thereby of the connecting pin 11 extend normal to the axis of the end section 5. The axis of the end section 5, in turn, coincides with the axis of the central section 3.

The connecting pin 11 serves to hold a link 12' of a suspension chain 12 and a suspension or sling member 13. The dimensions and strength values of the connecting pin 11, the chain link 12' and the suspension or sling member 13 are determined in accordance with a certain quality grade required in mechanically assembled systems.

The side walls 7 and 8 of the U-shaped end section 6 are spaced from one another by a distance which is determined in dependence upon the length and the diameter of the connecting pin 11 and is such that the member 12' and 13 to be connected with one another can be received between the side walls 7 and 8. More particularly, the distance between the side walls 7 and 8 is such that arms 14 and 15 of the suspension or sling member 13 surrounding the chain link 12', can be received between the end walls 7 and 8.

The suspension or sling member 13 may be formed as a shackle, suspension ring, sling hook or the like. It has a head which is secured to the connecting pin 11 by locking pins 18 and 19.

The second end section 6 has a bottom wall 16 provided with an opening 17 which extends parallel to the connecting pin 11 from one side wall 7 to the other side wall 8. The suspension or sling member 13 extends through the opening 17 with play.

The first end section 5 formed as a retaining boss, the central section 3, and the U-shaped second end section 6 including the side walls 7 and 8 and a bottom wall 16, together form an integral member. This integral member may be produced by drop-forging process.

It will be understood that each of the elements described above, or two or more together, may also find a useful application in other types of constructions differing from the types described above.

While the invention has been illustrated and described as embodied in a sling mounting head, it is not intended to be limited to the details shown, since various modifications and structural changes may be made without departing in any way from the spirit of the present invention.

Without further analysis, the foregoing will so fully reveal the gist of the present invention that others can, by applying current knolwedge, readily adapt it for various applications without omitting features that, from the standpoint or prior art, fairly constitute essential characteristics of the generic or specific aspects of this invention.

What is claimed as new and desired to be protected by Letters Patent is set forth in the appended claims:

1. A sling mounting head for use with a spacer element and mounting two members of a sling chain one of which members is a suspension member of a predetermined transverse dimension and has a fork head including two arms, whereas the other of these members is a sling chain link member arranged to be received between the arms of the fork head of the suspension member, the sling mounting head comprising a body portion having a central section with an axis and two axially spaced opposite faces, a first end section extending from one face of said central section in one axial direction and arranged to releasably retain the spacing element, and a box-shaped second end section including two side walls and a bottom wall extending from the other face of said central section in opposite axial direction, said side walls of said second end section being formed as forked plates which are substantially parallel to and spaced from one another by such a distance that they form a gap therebetween in which the suspension member is received, said bottom wall of said second end section having an opening through which one of the two members extends, said central section, said first end section, and said side and bottom wall of said second end section together forming an integral member; and means for connecting the two members with one another and retaining them in said body portion, and mounted in said side walls of said second end section of said body portion.

2. A sling mounting head as defined in claim 1, wherein the means for connecting and retaining includes a connecting pin of a predetermined size arranged for connecting the two members with one another and retaining at least one of the two members in said body portion, said side walls of said second end section being provided with holes for releasably receiving the connecting pin.

3. A sling mounting head as defined in claim 2, wherein said holes have axes extending normal to said axis of said central section so that the connecting pin extend normal to said axis of said central section in received condition.

4. A sling mounting head as defined in claim 1, wherein the fork head of the suspension member has a predetermined cross sectional area, said opening of said bottom wall having dimensions somewhat exceeding said cross sectional area of the suspension member so that the latter extends through said opening with play.

5. A sling mounting head as defined in claim 1, wherein said fork plates are spaced from one another in a direction transverse to said axis and located at opposite lateral sides of said axis.

6. A sling mounting head as defined in claim 1, wherein said first end section is formed as a cylindrical boss.

7. A sling mounting head as defined in claim 6, wherein said cylindrical boss has an axis coinciding with said axis of said central section.

8. A sling mounting head as defined in claim 6, wherein the spacer element is tubular and has an inner hollow, said cylindrical boss being formed so as to be inserted into the hollow of the spacing element.

9. A sling mounting head as defined in claim 1, wherein said integral member is a drop-forged member.

10. A sling mounting head as defined in claim 1, wherein said second end section is U-shaped.

11. A sling mounting head as defined in claim 1, wherein said side walls of said second end section have inner faces facing toward and arranged relative to one another so that the suspension member is received in said gap without intruding into said inner faces.

* * * * *

UNITED STATES PATENT AND TRADEMARK OFFICE

CERTIFICATE OF CORRECTION

PATENT NO. : 4,215,891

DATED : August 5, 1980

INVENTOR(S) : Alfred Thiele

It is certified that error appears in the above—identified patent and that said Letters Patent is hereby corrected as shown below:

In the heading, the name and address of the assignee should be added, and read -- FA. AUGUST THIELE, Federal Republic of Germany --.

Signed and Sealed this

*First* Day of *February 1983*

[SEAL]

*Attest:*

GERALD J. MOSSINGHOFF

*Attesting Officer*

*Commissioner of Patents and Trademarks*